US008607754B2

(12) United States Patent
Dorn et al.

(10) Patent No.: US 8,607,754 B2
(45) Date of Patent: Dec. 17, 2013

(54) ROLLER TAPPET

(75) Inventors: Stefan Dorn, Hollfeld (DE); Norbert Geyer, Hochstadt (DE); Karsten Kucht, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 21 days.

(21) Appl. No.: 13/512,413

(22) PCT Filed: Oct. 14, 2010

(86) PCT No.: PCT/EP2010/065408

§ 371 (c)(1),
(2), (4) Date: May 29, 2012

(87) PCT Pub. No.: WO2011/064044

PCT Pub. Date: Jun. 3, 2011

(65) Prior Publication Data

US 2012/0234277 A1 Sep. 20, 2012

(30) Foreign Application Priority Data

Nov. 30, 2009 (DE) ..... 10 2009 056 306

(51) Int. Cl.
*F01L 1/14* (2006.01)

(52) U.S. Cl.
USPC ..... 123/90.48; 123/90.44; 123/90.45; 123/90.5; 123/90.52

(58) Field of Classification Search
USPC ..... 123/90.44, 90.45, 90.46, 90.48, 90.5, 123/90.52
See application file for complete search history.

(56) References Cited

U.S. PATENT DOCUMENTS

| | | | | |
|---|---|---|---|---|
| 8,474,427 | B2 * | 7/2013 | Dorn et al. | 123/90.48 |
| 2006/0110273 | A1 | 5/2006 | Shaull et al. | |

FOREIGN PATENT DOCUMENTS

| | | |
|---|---|---|
| DE | 3247026 | 6/1984 |
| DE | 3926185 | 2/1991 |
| DE | 102007018686 | 10/2008 |
| DE | 102008043847 | 5/2010 |
| JP | 2004324546 | 11/2004 |
| WO | 9814722 | 4/1998 |

* cited by examiner

*Primary Examiner* — Ching Chang
(74) *Attorney, Agent, or Firm* — Volpe and Koenig, P.C.

(57) ABSTRACT

The invention concerns a roller tappet (1) for a high pressure fuel pump, said roller tappet (1) comprising a housing (2) comprising on a drive side front end (3), a slide-mounted roller (4) serving as a running surface of a cam, said housing (2), as viewed in housing direction, comprising a bridge member (5) arranged below the roller (4), said bridge member (5) comprising on a front end (7) turned towards a driven side front end (6) of the housing (2), a support (8) for a tappet follower member, wherein a shell member (11) like a semi shell or a one-third shell separated out of a rolling bearing ring is seated in a cylindrical cavity (9) of a further drive side front end (10) of the bridge member (5), and the roller (4) extends for sliding displacement directly in said shell member (11).

21 Claims, 2 Drawing Sheets

ROLLER TAPPET

FIELD OF THE INVENTION

The invention concerns a roller tappet, particularly for a high pressure fuel pump or for a valve train of a quality or quantity regulated internal combustion engine, said roller tappet comprising a housing comprising on a drive side front end, a slide-mounted roller serving as a running surface of a cam or an eccentric, said housing, as viewed in housing direction, comprising a bridge member arranged below the roller, said bridge member comprising on a front end turned towards a driven side front end of the housing, a support for a tappet follower member.

BACKGROUND

In a generic roller tappet disclosed in DE 32 47 026 A1, a roller is seated in a cylindrical pocket of a drive side of a housing. For retention of the roller, the housing projects with its drive side front end beyond half the height of the roller which is received in a bridge member integrally connected to the housing. Axial securing of the roller is realized through separate pins.

A drawback of the aforesaid roller is that, for a mass production, it can be made only by a complex fabrication method. This requires, for example, an extremely close tolerance in the retention region of the roller. Moreover, angular deviations of the surrounding structure have a detrimental effect so that friction-raising "edge loading" has to be reckoned with, or very close tolerances have likewise to be observed in this section. In addition, it is noted that the roller tappet has an unnecessary solid configuration.

SUMMARY

It is an object of the invention to provide a roller tappet of the pre-cited type in which the cited drawbacks are eliminated. In particular, a roller tappet must be created that can be manufactured extremely economically in mass production.

The above object is achieved according to the invention in that a shell member like a semi shell or a one-third shell separated out of a ring such as a rolling bearing ring is seated in a cavity of a further drive side front end of the bridge member, said roller extending for sliding displacement directly in said shell member.

In this way, a roller tappet is created in which the aforesaid drawbacks are eliminated. For the introduction of forces, the invention uses a shell member made by separating out a mass-produced rolling bearing ring. Suitable for use as a rolling bearing ring, for instance, is a cam-contacting ring from the field of valve drives as used, for example, in connection with finger levers or roller tappets. This standard component is subjected to a separating process like cracking so that two or three shell members are made for example from each rolling bearing ring. The cavity for the shell member can be described, for instance, as a cylindrical or gothic profile.

The proposed roller tappet is intended, for example, to follow a periodic lift producer like a cam or an eccentric in a high pressure fuel pump. The roller tappet can equally well be used as a cam follower in a valve train of an internal combustion engine (cup or roller tappet with overhead or bottom camshaft).

The shell-type mounting arrangement without lateral framing-in of the roller in bores of the housing has resulted in a good load supporting pattern. The roller tappet is excellently suitable for use in currently used high speed pumps.

The housing of the roller tappet is made preferably by deep drawing out of a light-weight material like sheet steel. Advantageously, during the deep drawing step, opposing flats are configured for realizing a lateral contact of the front end surfaces of the roller. For weight-saving purposes, these flats, but also other peripheral regions of housing, may comprise appropriate recesses or apertures.

According to one proposition of the invention, integrally formed anti-loss regions such as projections for the slightly axially movable roller extend from the section of the flats. A person with ordinary skill in the art will recognize that, for this purpose, it is not necessary to work with very high precision so that a further contribution is made towards reducing manufacturing costs.

According to one specific proposal of the invention, suitable projections for retaining the roller can be, for instance, knob-like shaped parts that project from inner sides of the flats slightly beyond the front side end regions of the roller.

An alternative proposal in this connection is to configure respective projections in form of roof regions of a shell-like cavity on the flats.

According to a further variation, the anti-loss regions may also be made in the form of finger-like extensions starting from the inner periphery of the housing while being situated diametrically opposite to each other, with undersides of these extensions engaging partially over the roller. It is clear that a summit part of the roller projects beyond upper sides of the extensions.

Another possibility is for the roller to be retained in the region of front end surfaces through notch-like cavities that start from the outer periphery of the housing and extend inwards in radial direction. More exactly, the roller is fixed through inner roof segments formed by the cavities.

According to a further proposal of the invention, it is possible to dispense with the aforesaid flats on the housing. In this case, the roller runs with its front end surfaces against the cylindrically vaulted counter surfaces of the inner periphery of the housing.

The bridge member in which the shell member is received is advantageously made as a separate component but may also be connected integrally to the housing. In the case of a configuration as a separate component, the bridge member is made, for example, out of thin-walled sheet steel. This is a further contribution towards obtaining a light-weight structure and reducing manufacturing costs.

According to one advantageous embodiment of the invention, a lug-like extension of the bridge member may extend through a corresponding aperture in the housing. In this way, a simple anti-rotation device is created for the roller tappet, and a separate anti-rotation body in the skirt of the roller tappet can be dispensed with.

Alternatively to the aforesaid sheet metal configuration of the housing, the housing may also be made by extrusion molding or chip removal.

According to a further proposition of the invention, a knob-like protruding support for the tappet follower element is generated on a front end of the bridge member turned towards a driven side front end of the housing. This support can be realized, for instance, as a partial material stamping/embossing that starts from a further front end of the bridge member.

Suitable for use as a separating method for the rolling bearing ring are, for example, the aforesaid cracking method or grinding, milling/sawing etc.

The roller can have the configuration of a ring or a cylinder. Preferably, the invention intends to use standard components for this purpose.

Finally, the invention proposes an end profiling of the outer periphery of the roller or the shell member. This measure permits a simple compensation of alignment errors. If necessary, even the cavity in the bridge member may be thus treated.

DETAILED DESCRIPTION OF THE PREFERRED EMBODIMENTS

Figure 1:
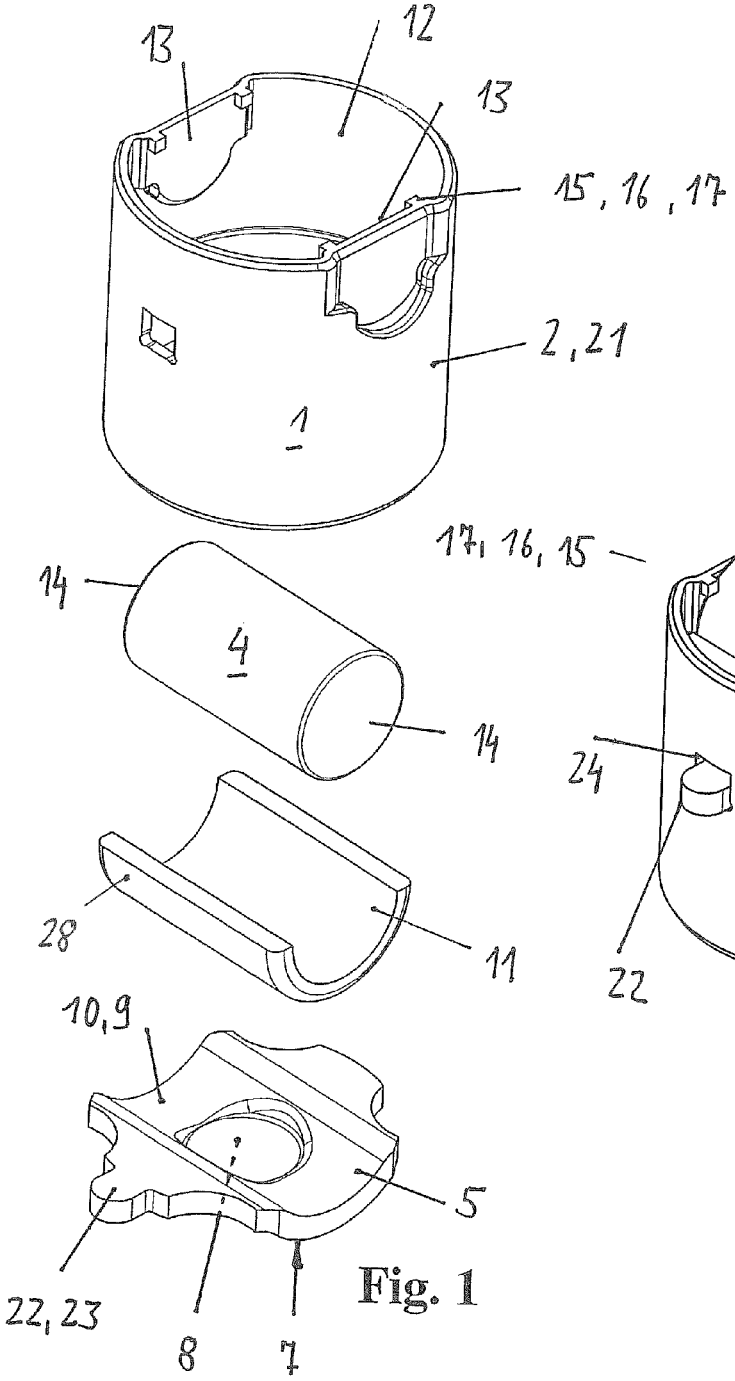
FIG. 1 shows an exploded representation of a roller tappet comprising a shell member.
Figure 2:
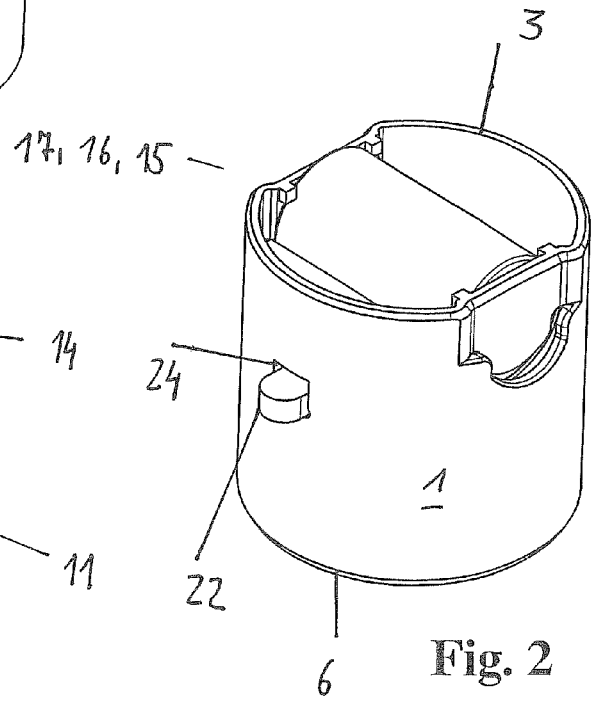
FIG. 2 shows the aforesaid roller tappet in an assembled state.

FIG. 1 discloses a roller tappet 1 as used for a counter running component for a cam or an eccentric in a high pressure fuel pump (for instance for pumping diesel oil). The roller tappet 1 comprises a substantially cylindrical housing 2 over whose outer periphery 21 oil is guided into a reception of the high pressure fuel pump or a surrounding structure. In the region of a drive side front end 3, a roller 4 extends through the housing 2 in crosswise direction. According to the solutions shown in FIGS. 1 to 6, the roller 4 runs with its front end surface 14 against inner sides of respective flats 13. These flats 13 are configured as material stampings.

The roller 4 is slide mounted in a shell member 11 that is separated out of a rolling bearing ring available as a standard component. Suitable for use as a separating method is, for example, cracking so that two or three shell members can be generated out of a single rolling bearing ring.

The shell member 11 is received in a complementary cavity 9 of a front end 10 of a separate thin-walled bridge member 5. The bridge member 5 is made out of sheet steel and bears with edge regions of its front end 10 against undersides of the flats 13.

As best disclosed in FIG. 1, the bridge member 5 comprises a lug-like extension 23. This lug-like extension 23 (see FIG. 2) extends through a window-like aperture 24 in the housing 2 and thus forms an anti-rotation device 22 for the housing 2.

On a lower front end 7, the bridge member 5 comprises a knob-like projecting support 8 which starts basically as a material stamping from the front end 10. In the installed state, a body of a pump piston bears against this support 8.

The roller 4 is retained by anti-loss regions 15 configured on the housing 2. These anti-loss regions 15 are configured as projections 16 starting integrally from the flats 13 and are made, according to FIGS. 1, 2, in the form of knob-like shaped parts 17 that point in axial direction of the roller 4.

Figure 3:
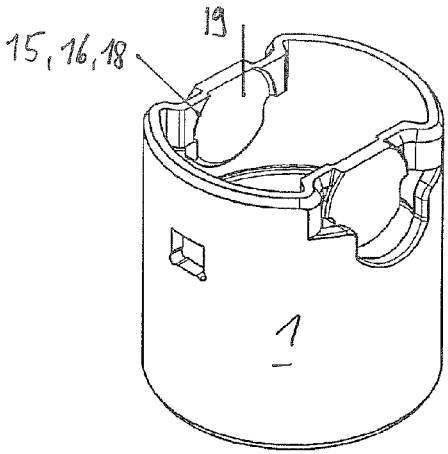
FIGS. 3, 5 and 7 show the housing of the roller tappet comprising different variations of a retaining/anti-loss device for the roller.
Figure 4:
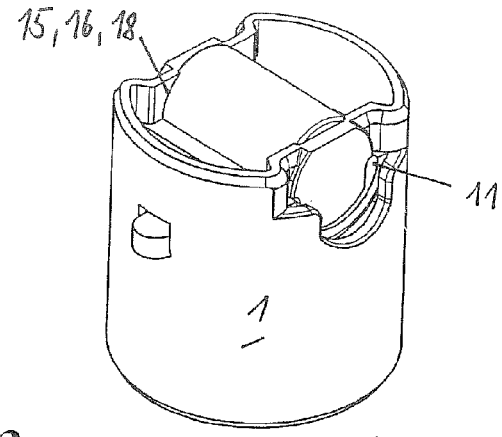
FIGS. 4, 6 and 8 show the roller tappet in an assembled state and match the variations of the anti-loss device respectively of FIGS. 3, 5 and 7.

An alternative configuration of the anti-loss regions 15 is disclosed in FIGS. 3, 4. In this configuration, the projections 16 of each flat 13 are formed by a roof region 18 of a shell-like cavity 19.

Figure 5:
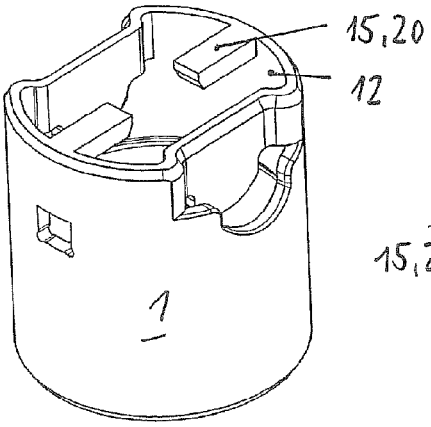
Figure 6:
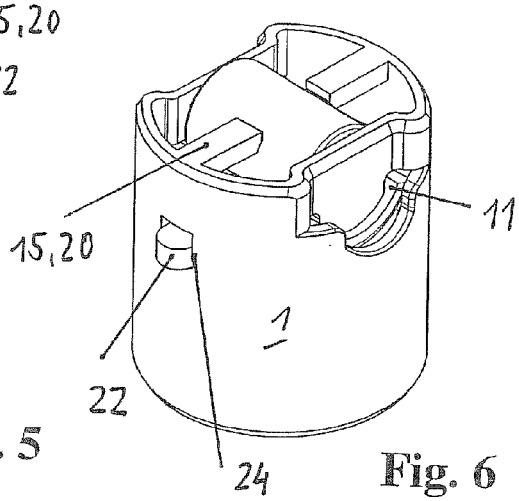

According to FIGS. 5, 6, the anti-loss regions 15 are constituted by two finger-like extensions 20 situated opposite each other. These extensions 20 start from the inner periphery 12 of the housing 2 in the vicinity of the drive side front end 3 and extend perpendicularly to the axial line of the roller 4.

Figure 7:
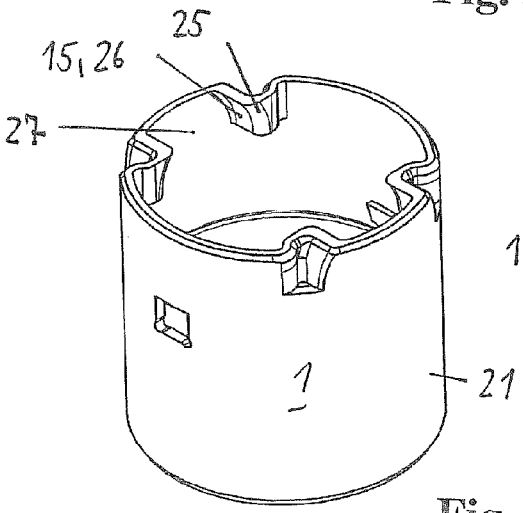
Figure 8:
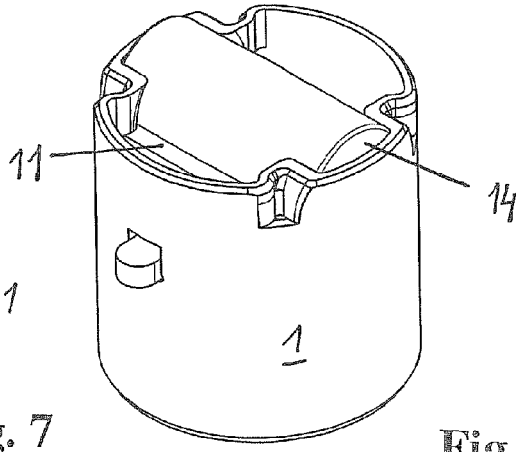

According to FIGS. 7, 8, the anti-loss regions 15 in the outer periphery 21 of the housing 2 are constituted by two pairs of peripherally spaced notch-like cavities 25 that are configured in the vicinity of the drive side front end 3 and form inner roof segments 26 under which the roller 4 is retained.

The roller tappet 1, whose housing 2 and bridge member 5 are made out of thin-walled sheet steel and whose roller 4, at the same time, is mounted for sliding in a simple slide mounting arrangement in a shell member 11 separated out of a rolling bearing ring, possesses a simple structure and can be manufactured economically in mass production. The roller tappet 1 is excellently suitable for use in a diesel or gasoline pump of the latest state of the art.

LIST OF REFERENCE NUMERALS

1 Roller tappet
2 Housing
3 Drive side front end of housing
4 Roller
5 Bridge member
6 Driven side front end of housing
7 One front end of bridge member
8 Support
9 Cavity
10 Further front end of bridge member
11 Shell member
12 Inner periphery of housing
13 Flat
14 Front end surface of roller
15 Anti-loss region
16 Projection
17 Shaped part
18 Roof region
19 Shell-like cavity
20 Finger-like extension
21 Outer periphery of housing
22 Anti-rotation device
23 Lug-like extension
24 Aperture
25 Notch-like cavity
26 Roof segment
27 Inner peripheral section
28 Outer periphery of shell member

The invention claimed is:

1. A roller tappet, comprising a housing that includes on a drive side front end, a slide-mounted roller that forms a running surface for a cam or an eccentric, a bridge member arranged in the housing below the roller, said bridge member comprising on a front end turned towards a driven side front end of the housing, a support for a tappet follower member, a shell member formed as a portion of a ring is seated in a cavity of a drive side front end of the bridge member, said roller extending for sliding displacement directly in said shell member.

2. A roller tappet according to claim 1, wherein two flats are arranged diametrically opposite each other on an inner periphery of the housing in a vicinity of the drive side front end, and the roller includes front end surfaces that run on said flats.

3. A roller tappet according to claim 2, wherein the flats are stamped in from an outer periphery of the housing.

4. A roller tappet according to claim 2, wherein the flats have a closed configuration.

5. A roller tappet according to claim 2, wherein each of the flats comprises an opening like a bore.

6. A roller tappet according to claim 1, wherein anti-loss regions are arranged in a section of the drive side end of the housing to partially overlap the roller.

7. A roller tappet according to claim 6, wherein the anti-loss regions are configured as projections extending integrally from the flats.

8. A roller tappet according to claim 7, wherein the projections of each of the flats are formed by two knob-like shaped parts that point in an axial direction of the roller, the roller being retained under said shaped parts.

9. A roller tappet according to claim 7, wherein the projections of each of the flats are formed by a roof region of a shell-like cavity in said flat.

10. A roller tappet according to claim 6, wherein the anti-loss regions are configured as at least two diametrically opposing finger-like extensions that start from an inner periphery of the housing in a vicinity of the drive side front end, or directly from the drive side front end, and extend perpendicularly to an axial line of the roller.

11. A roller tappet according to claim 6, wherein in an outer periphery of the housing, in a vicinity of the drive side front end, two peripherally spaced notch-like cavities for each front end surface of the roller are arranged for forming inner roof segments for the anti-loss regions, and the roller is retained under said roof segments.

12. A roller tappet according to claim 11, wherein the roller is laterally guided between the roof segments through the front end surfaces on at least substantially cylindrical inner peripheral sections of the housing.

13. A roller tappet according to claim 6, wherein the roller is either a solid or a hollow cylinder.

14. A roller tappet according to claim 1, wherein the portion of the ring out of which the shell member is made as a fine finished standard component.

15. A roller tappet according to claim 1, wherein the bridge member is a separate sheet steel part.

16. A roller tappet according to claim 15, wherein the support for the tappet follower part in the bridge member is made as an embossing or as a partial material stamping starting from the drive side front end of the bridge member.

17. A roller tappet according to claim 1, wherein an anti-rotation device projects beyond an outer periphery of the housing.

18. A roller tappet according to claim 17, wherein the anti-rotation device is formed as an integral, lug-like extension of the bridge member that extends through a corresponding aperture of the housing.

19. A roller tappet according to claim 1, wherein the housing is made from sheet steel.

20. A roller tappet according to claim 1, wherein the shell member is created out of a rolling bearing ring by a separating method including at least one of cracking, grinding, milling, or sawing.

21. A roller tappet according to claim 1, wherein either a) an outer periphery of the shell member is crowned or end profiled, or b) the roller is crowned or end profiled, or c) both the outer periphery of the shell member and the roller are crowned or end profiled.

* * * * *